US011390968B2

(12) United States Patent
D'Agnolo et al.

(10) Patent No.: US 11,390,968 B2
(45) Date of Patent: Jul. 19, 2022

(54) DRAWING APPARATUS AND METHOD FOR AIR SPINNING MACHINES WITH MULTIPLE FEEDS

(71) Applicant: SAVIO MACCHINE TESSILI S.p.A., Pordenone (IT)

(72) Inventors: Fabio D'Agnolo, Pordenone (IT); Luca Deotto, Pordenone (IT); Luca De Vecchi, Pordenone (IT); Luigi Gorgatti, Pordenone (IT)

(73) Assignee: SAVIO MACCHINE TESSILI S.P.A.

( * ) Notice: Subject to any disclaimer, the term of this patent is extended or adjusted under 35 U.S.C. 154(b) by 146 days.

(21) Appl. No.: 16/674,166

(22) Filed: Nov. 5, 2019

(65) Prior Publication Data

US 2020/0149197 A1 May 14, 2020

(30) Foreign Application Priority Data

Nov. 9, 2018 (IT) ..... 102018000010209

(51) Int. Cl.

| | |
|---|---|
| ***D01H 5/82*** | (2006.01) |
| ***D01H 5/50*** | (2006.01) |
| ***D01H 5/32*** | (2006.01) |
| *D01H 4/02* | (2006.01) |
| *D01H 4/30* | (2006.01) |

(52) U.S. Cl.
CPC ..... *D01H 5/82* (2013.01); *D01H 5/32* (2013.01); *D01H 5/50* (2013.01); *D01H 4/02* (2013.01); *D01H 4/30* (2013.01)

(58) Field of Classification Search
CPC ..... D01H 5/32; D01H 5/50; D01H 5/82
See application file for complete search history.

(56) References Cited

U.S. PATENT DOCUMENTS

| | | | | |
|---|---|---|---|---|
| 4,473,924 | A * | 10/1984 | Hartmannsgruber .. | B65H 54/80 19/239 |
| 6,182,333 | B1 * | 2/2001 | Lauhus ..... | D01H 5/80 19/236 |
| 10,316,434 | B2 * | 6/2019 | Gao ..... | D02G 3/34 |
| 10,316,435 | B2 * | 6/2019 | Xue ..... | D01H 5/74 |
| 10,316,436 | B2 * | 6/2019 | Xue ..... | D01H 5/36 |
| 10,351,975 | B2 * | 7/2019 | Gao ..... | D01H 5/74 |
| 2017/0051439 | A1 * | 2/2017 | Gao ..... | D01H 5/36 |
| 2017/0067188 | A1 * | 3/2017 | Xue ..... | D01H 5/22 |

(Continued)

FOREIGN PATENT DOCUMENTS

| | | |
|---|---|---|
| CN | 1587469 | 3/2005 |
| EP | 3045576 | 7/2016 |
| EP | 3048192 | 7/2016 |

(Continued)

OTHER PUBLICATIONS

Italian Search Report, dated Jul. 22, 2019.

*Primary Examiner* — Shaun R Hurley
(74) *Attorney, Agent, or Firm* — Valauskas Corder LLC

(57) ABSTRACT

A drawing apparatus for air spinning machines with multiple feeds includes independent introducer elements that feed simultaneously at least two separate slivers of textile fiber. A first drive roller intercepts a first sliver and a second drive roller intercepts the second sliver. The drive rollers may be operated at different speeds of rotation, to perform different degrees of drawing of the two slivers.

21 Claims, 7 Drawing Sheets

(56) References Cited

U.S. PATENT DOCUMENTS

| | | | | |
|---|---|---|---|---|
| 2017/0073849 | A1* | 3/2017 | Gao | D02G 3/04 |
| 2017/0268134 | A1* | 9/2017 | Xue | D02G 3/346 |

FOREIGN PATENT DOCUMENTS

| | | | | |
|---|---|---|---|---|
| EP | 3321401 | | 5/2018 | |
| WO | 2011/018685 | | 2/2011 | |
| WO | WO-2015024356 | A1 * | 2/2015 | D01H 5/22 |

* cited by examiner

DRAWING APPARATUS AND METHOD FOR AIR SPINNING MACHINES WITH MULTIPLE FEEDS

CROSS-REFERENCE TO RELATED APPLICATIONS

The present invention claims priority to Italian Patent Application No. 102018000010209 filed on Nov. 9, 2018.

SCOPE

The present invention concerns a drawing apparatus and a method for air spinning machines, for example of the air-jet type, with multiple feeds.

STATE OF THE ART

As is known, air-let type spinning apparatuses produce yarn from a single fiber sliver. The specific area of development of the present invention is that of yarns obtained from multiple slivers of fibers which may be of different materials, of different colors (mélange), of different quality or even of the same material. These multiple feed slivers must be appropriately drawn and blended in order to make a yarn with the desired characteristics.

To date, the process for obtaining slivers with different, color or material may be of two types. The first provides for weighing raw materials based on the percentage ratio one wishes to obtain, for example 50% cotton and 50% polyester, and the subsequent entry into the standard production cycle of the sliver. The second type provides for preparing several slivers, usually in the number of six or eight, and of suitable yarn count, which are subsequently processed repeatedly on a drawing frame until a homogeneous sliver is obtained. The result, in both cases, is a sliver of blended material with good blending of the different fibers to be used to feed air spinners, for example, of the air-jet type. The traditional processes described above, while guaranteeing a good quality of the yarn obtained, are, however, expensive, since the coupling of the various blends requires care and additional processing. This type of known processing is currently used for mélange-type yarns and for blended yarns (cotton/polyester, cotton/viscose, etc.).

In addition, the known solution has the disadvantage of requiring machining on a single sliver of blended material: in this way, the introducer tube of such blended sliver within the drawing devices subject to fiber contamination, for example, of colored material embedded within the same blended sliver. This means that the transit from one blended sliver to another requires the prior cleaning of the introducer tube to prevent contamination of the following sliver.

In addition, the known solutions require modifying the spinning machine's calibration according to the blended yarn to be processed; this means that it is necessary to change the machine settings from time to time depending on the yarn count of the blended sliver to be drawn.

Moreover, the known solutions do not allow the use of carded cotton for spinning with air-jet-type systems as the fiber lengths are too short and the low homogeneity make the processing thereof impossible on the current air drawing systems, whereas with the proposed solution, blending carded fiber with combed fiber at a suitable percentage allows the spinning of carded-type cotton even with air-jet-type spinning systems.

It is also known to make spinning apparatuses wherein the slivers introduced by the respective introducer tubes are drawn separately from each other through pairs of drawing rollers with separate motors. This separation therefore allows the slivers to be drawn separately and differently from each other, depending on the requirements, before the same are then fed into the spinning chamber. This solution certainly allows the composition of the yarn to be calibrated with greater precision due to a precise processing of the slivers according to the initial features of the same slivers (yarn count, color, origin) before the same are joined in the spinning chamber. However, this known solution only works well if the individual adjustments/processing on the individual slivers are optimized and differentiated with extreme precision. In other words, the different processing set on the slivers must actually be obtainable. However, the apparatuses of the prior art do not allow the precision of differentiated processing on the individual slivers to be assured. In other words, if from a theoretical point of view these known solutions allow the formation of yarn to be optimized by separating the processing on the individual slivers, from a practical point of view it is not really possible to optimize the differences in processing on the same slivers because the known apparatuses do not allow the necessary processing precision, in particular in drawing, and the necessary sensitivity to the changes in settings imposed according to the different yarns.

PRESENTATION OF THE INVENTION

The need is therefore felt to resolve the drawbacks and limitations cited in reference to the prior art.

Such need is satisfied by a drawing apparatus and method for air spinning machines with multiple feeds and a drawing apparatus for air spinning machines according to the invention.

DESCRIPTION OF THE DRAWINGS

Further features and advantages of the present invention will become more apparent from the following description of the preferred and non-limiting examples of embodiment thereof, wherein.

Figure 1:
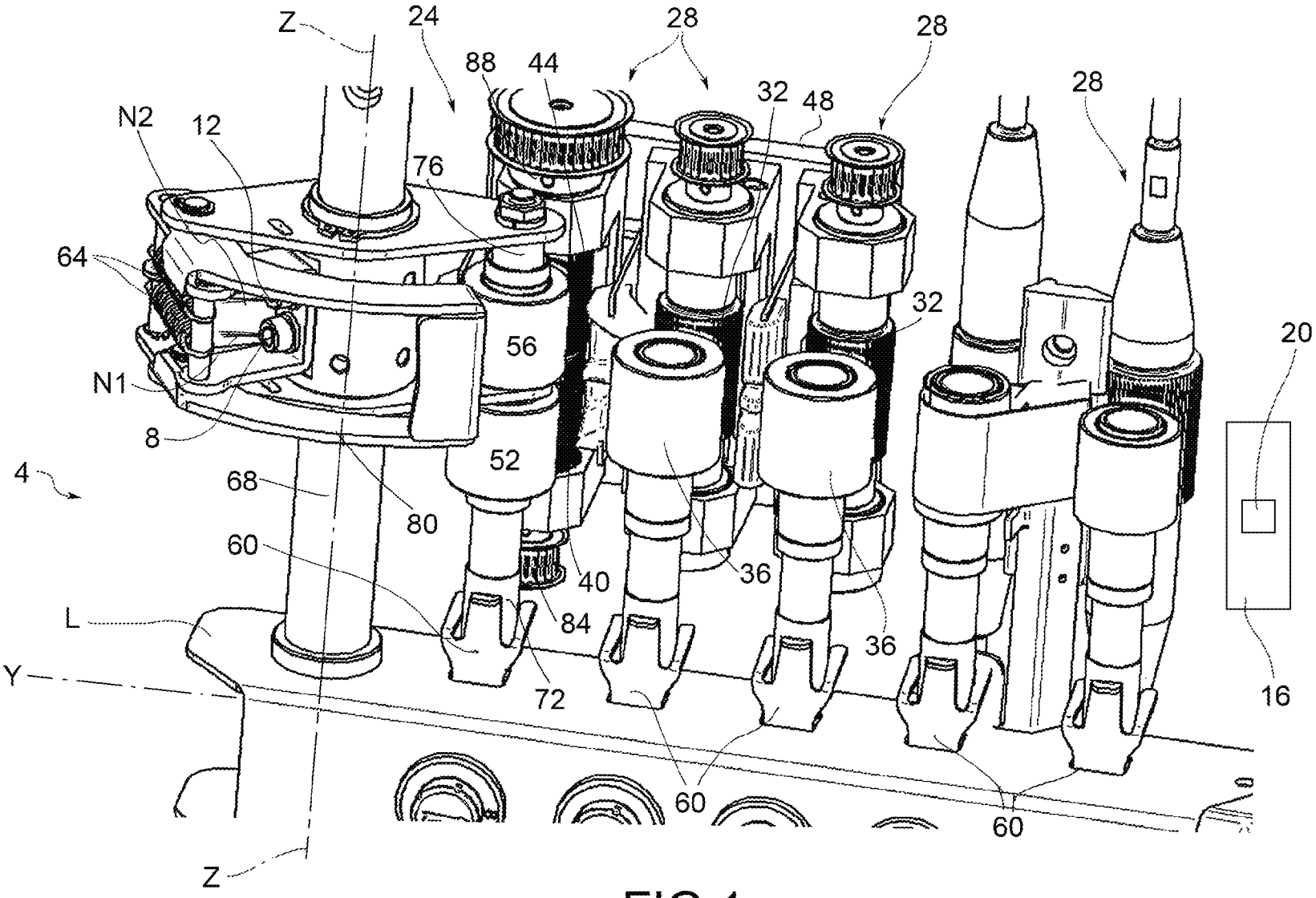
FIG. 1 shows a partial front perspective view of a drawing apparatus for air spinning machines for blended yarns according to an embodiment of the present invention.
Figure 2:
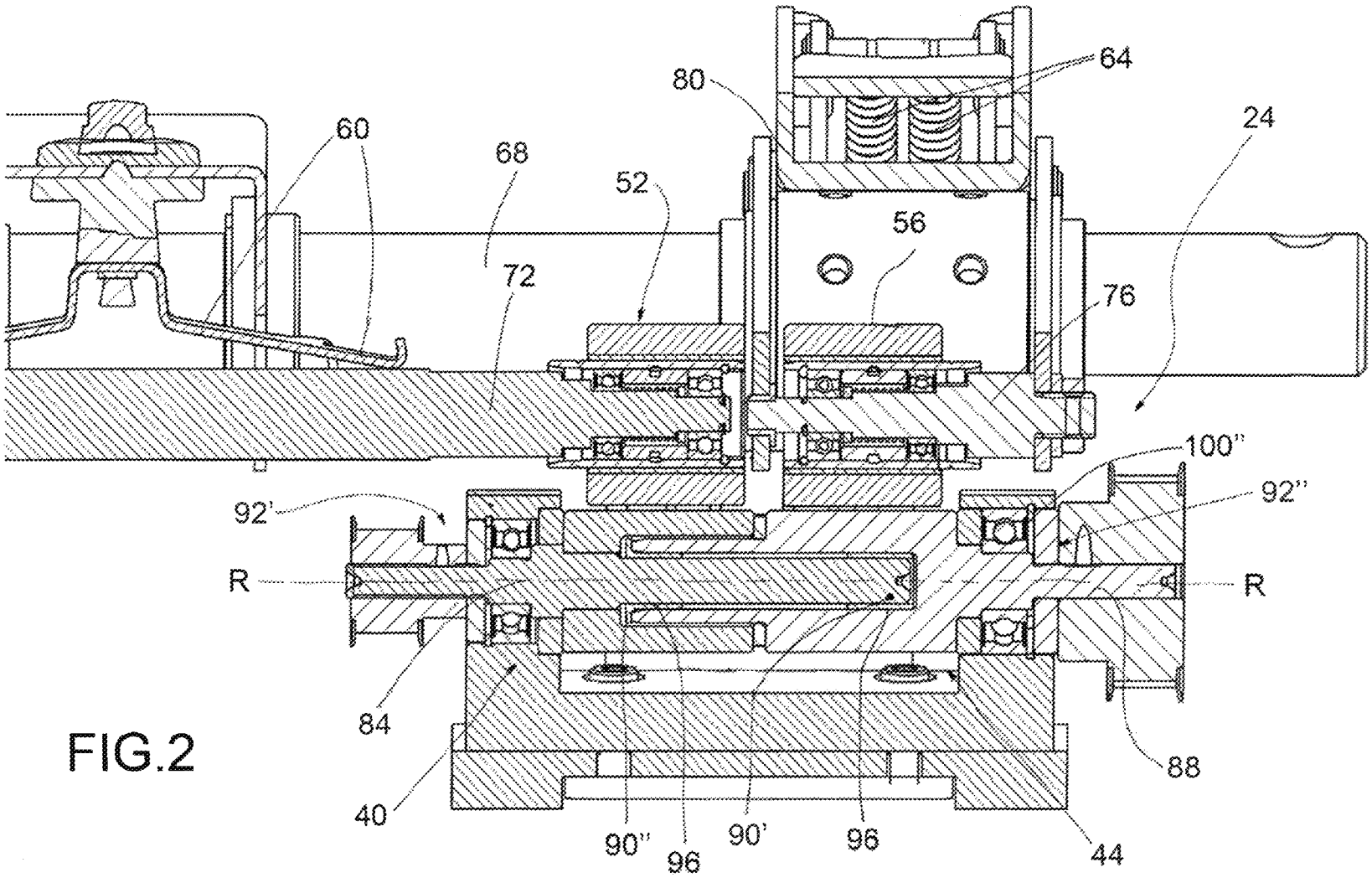
FIG. 2 shows a sectional view of the detail II in FIG. 1.
Figure 3:
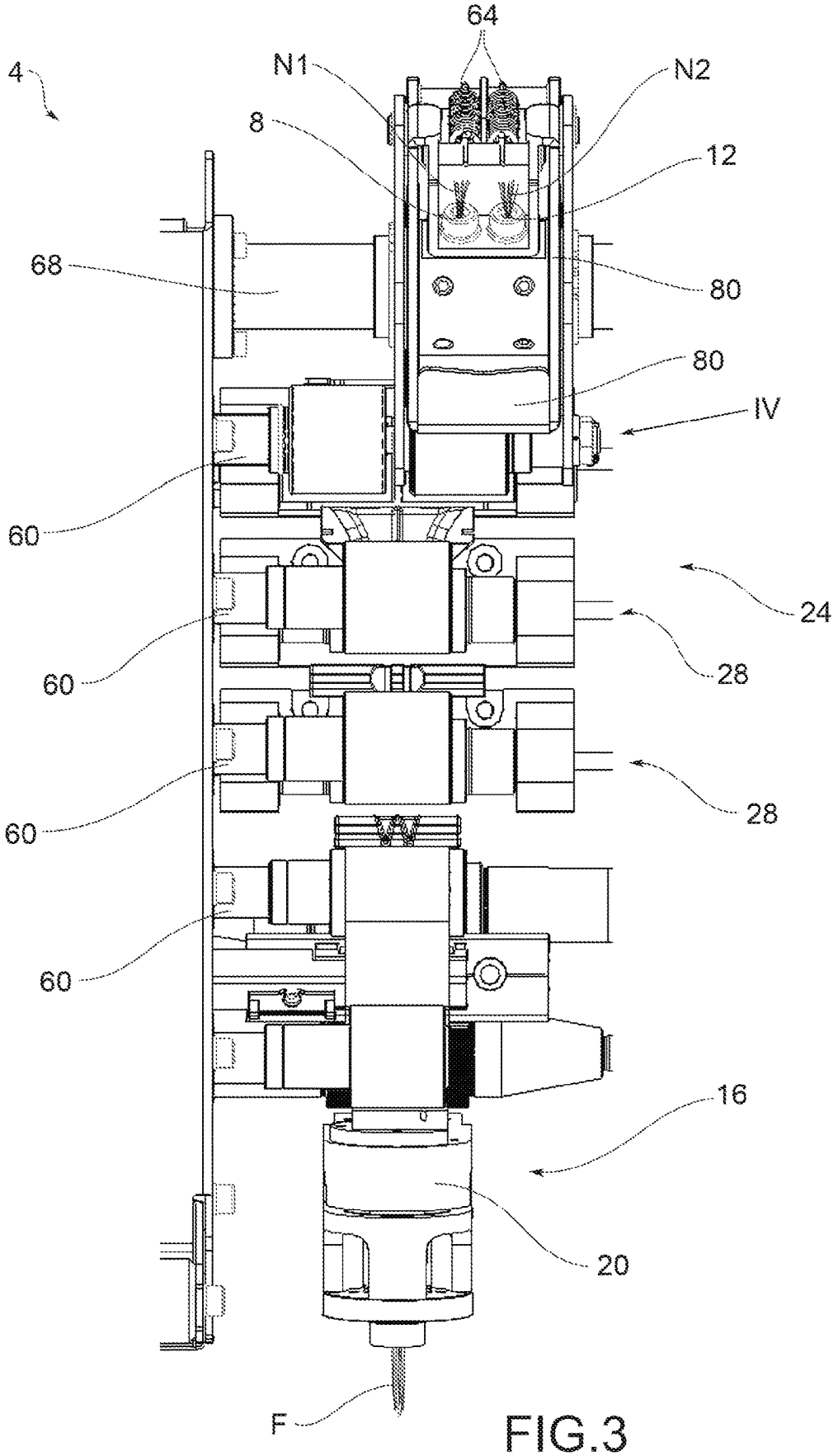
FIG. 3 shows a frontal view of a drawing apparatus complete with air spinning device, according to an embodiment of the present invention.
Figure 4:
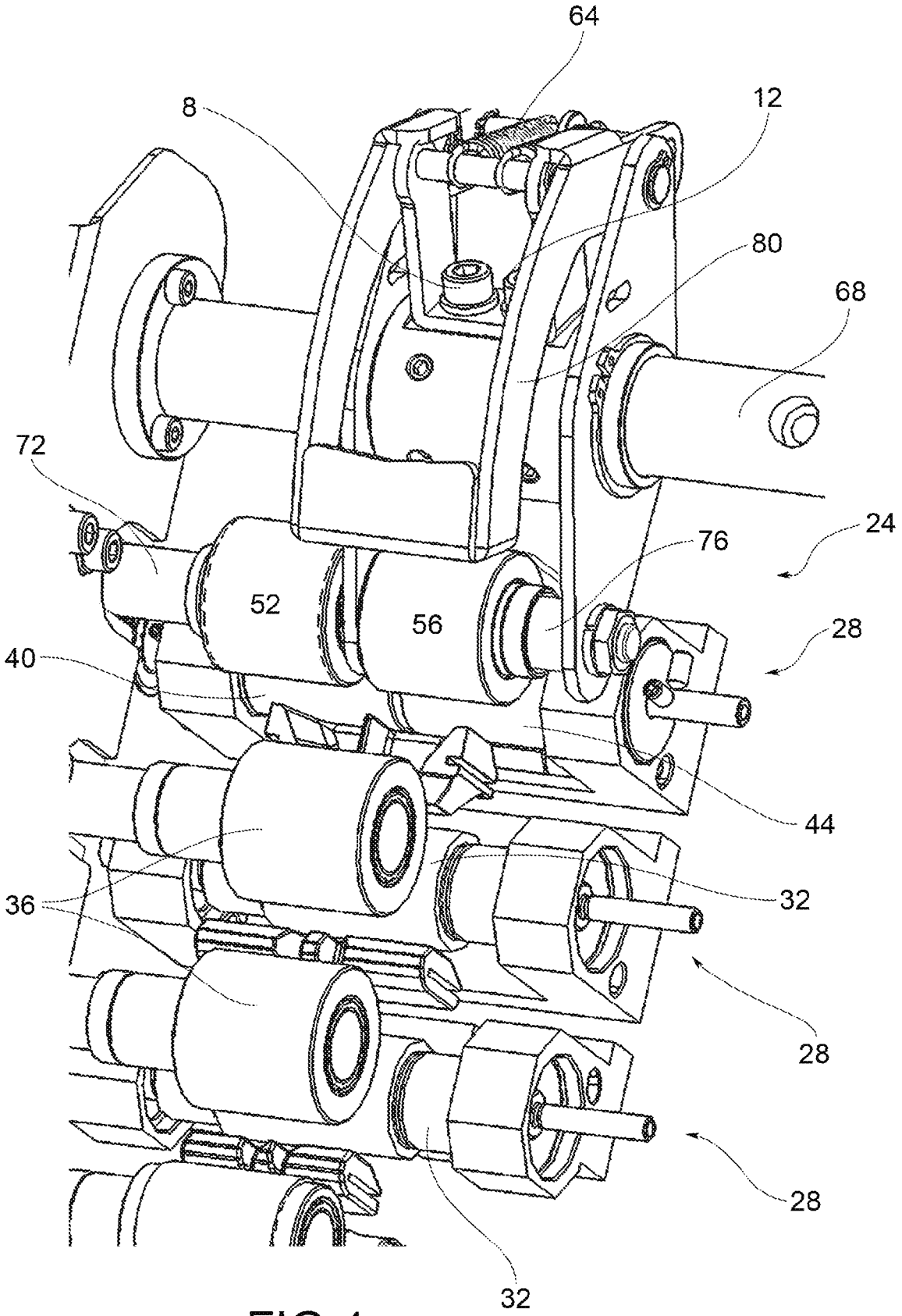
FIG. 4 shows a perspective view of the detail IV of the drawing apparatus, indicated in FIG. 3.
Figure 5:
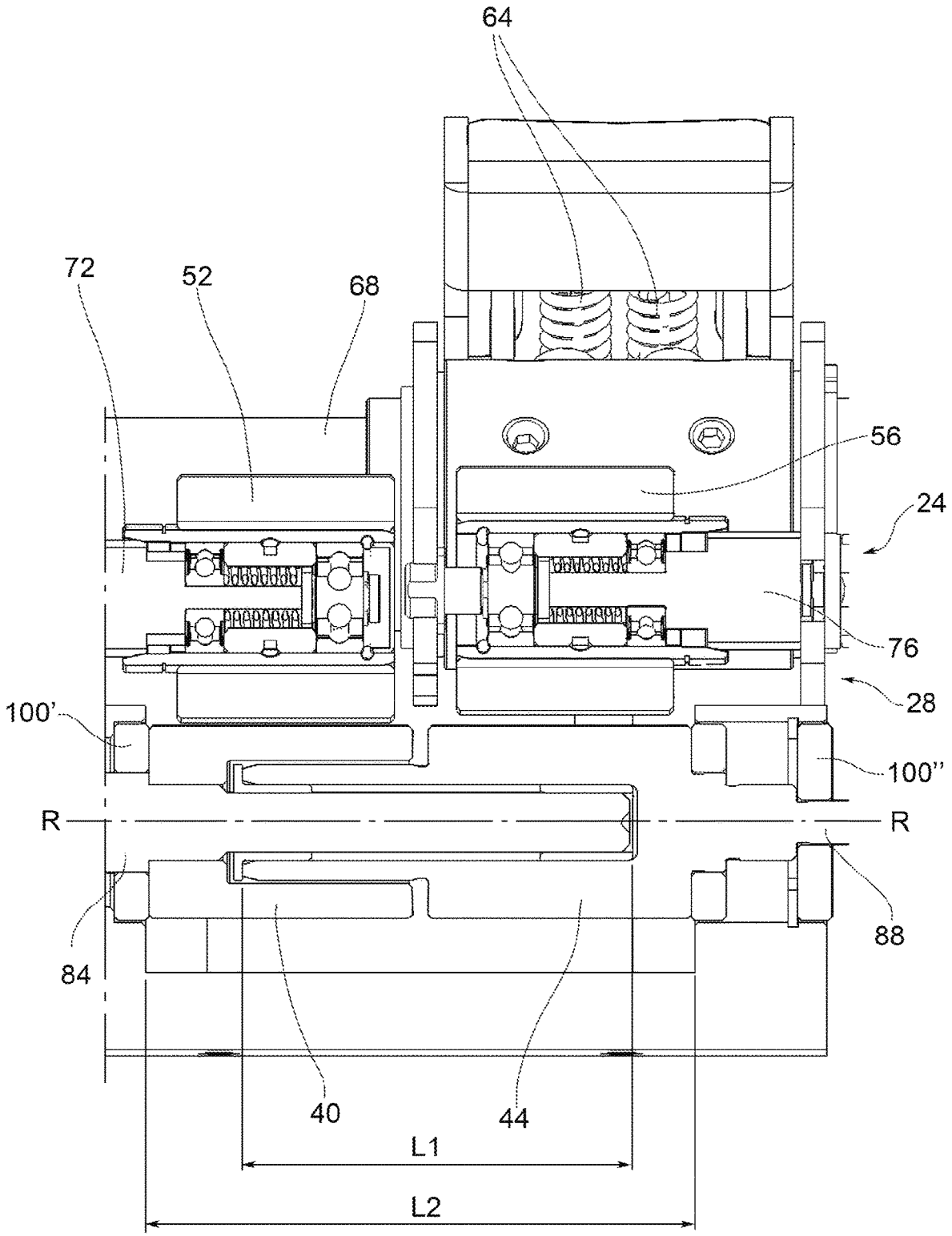
FIGS. 5,6,7 show sectional views of said detail IV indicated in FIG. 4, according to possible embodiments.

The elements or parts of elements is common between the embodiments described hereinafter will be indicated at the same numerical references.

DETAILED DESCRIPTION

With reference to the aforesaid figures, a drawing apparatus for air spinning machines with multiple feeds is indicated collectively at 4.

Said apparatus 4 comprises at least a first and a second introducer element 8,12, independent of each other, so as to be able to feed simultaneously at least two separate slivers of textile fiber N1, N2. Said slivers of textile fibers N1, N2 may either be the same as each other or different in quality, yarn count, color and/or material.

The apparatus 4 further comprises an air spinning device 16, fed with said slivers of textile fiber N1,N2, suitable to produce yarn with certain features.

For the purposes of the present invention, the air spinning device 16 may be of any type, shape and size.

For example, the air spinning device 16 comprises a spinning chamber 20 which comprises a plurality of air lets (not shown) oriented in a direction substantially tangential to the same slivers N1, N2 entering the same spinning chamber 20, so as to interweave said slivers N1, N2 together and obtain a single yarn F in output from the air spinning chamber 20.

As possible variant embodiments, the spinning chamber 20 may also comprise movable mechanical parts powered by compressed air.

The apparatus 4 further comprises a drawing device 24, placed between the introducer elements 8,12 and the air spinning device 16, comprising a plurality of pairs of drawing rollers 28, comprising at least one drive roller 32 per pair 28, said drawing rollers 28 being suitable to perform a progressive drawing of each sliver simultaneously intercepted thereby, in a known manner.

"Drive roller" 32 means a roller operatively connected to drive means, typically electric motors; usually each drive roller 32 faces an idle roller 36 which presses on the slivers N1, N2 at a suitable pressure and is set in motion by the drive roller 32 coupled thereto.

According to one embodiment, at least one drive roller 32 of a pair of said drawing rollers 28 of the spinning apparatus 4 is mechanically split into a first drive roller 40 which intercepts the first sliver N1 and a second drive roller 44 which intercepts the second sliver N2.

Said first and second drive rollers 40,44 are operatively connected to separate drive means so that they may be operated at different speeds of rotation to carry out different, degrees of drawing of the two slivers N1, N2 intercepted by said first and second drive rollers 40,44.

Preferably, said first drive roller 40 is associated with a first idle roller 52 and said second drive roller 44 is associated with a second idle roller 56, said idle rollers 52,56 being mechanically separate from each other.

Due to this split, each idle roller 52,56, will be able to follow, independently of the other 56,52, the degree of drawing (i.e., the speed of rotation) imposed by the corresponding drive roller 40,44.

According to a possible embodiment, said first idle roller 52 is associated with a first thrust means 60 that elastically biases it in contact with the first drive roller 40 and said second idle roller 56 is associated with a second thrust means 64 that elastically biases it in contact with the second drive roller 44.

Said first and second thrust means 60,64 are completely independent of each other: this means that each exerts its preload action or thrust independently of the other; so each may be modified, replaced or adjusted completely independently of the other, depending on the sliver N1,N2 on which the corresponding pair of cylinders 28 is to operate.

According to a possible embodiment, said thrust means 60,64 comprise coil springs and/or leaf springs.

Preferably, the first and second idle rollers 52,56 are supported cantilevered with respect to a frame 68 of the drawing device 24, on support shafts 72,76 mechanically separated from each other.

Preferably, these thrust means 60,64 comprise separately adjustable springs.

For example, the first thrust means 60 comprise a leaf spring which acts as a cantilever on the support shaft 72 of the first idle roller 52.

For example, the second thrust means 64 comprise at least one coil spring acting in compression on a bracket 80 that cantilevers the support shaft 76 of the second idle roller 56.

Obviously, there are several other possible arrangements for the said thrust means 60,64 and said support shaft 72,76.

The first and second drive rollers 40,44 are coaxial.

In particular, said first and second drive rollers 40,44 are supported by drive shafts 84,88 coaxial to each other and fixed in position with respect to the frame 68 of the drawing device 24.

"Fixed" means that the spatial orientation of said drive shaft 84,88 does not vary over time; obviously the drive shafts 84,88 are free to rotate under the thrust of the respective drive means.

These first and second drive rollers are axially opposed with respect to a common rotation axis R-R by the inner ends 90',90" facing each other, and are supported in rotation by the outer ends 92',92" opposite to said inner ends 90',90".

Preferably, said inner ends 90',90" are at least partially coaxially interpenetrated so as to rotate one in the other through the interposition of at least one bearing or bushing 96.

More specifically, the inner ends 90',90" are interpenetrated for the maximum possible length in order to reduce to a minimum the possibility that the axes of the drive shafts 84,88 are offset or do not coincide with each other; therefore any coupling play reduced to a minimum guaranteeing a single theoretical drawing axis for both drive shafts 84,88. For this purpose, the bearings or preferably bushings 96 are put in place.

Preferably, said inner ends 90',90" are interpenetrated for a penetration length L1 equal to at least 50% of a total cantilever length L2 between the outer ends 92',92". In other words, the outer ends 92',92" are supported by respective bearings or supports 100',100". These bearings 100',100" define a cantilevered portion having an overall cantilever length L2. The inner ends 90',90" are mutually interpenetrated for a segment having a penetration length L1 equal, as seen, to at least of the overall cantilever length L2.

According to an embodiment, the first and second split motor rollers 40,44 are arranged directly facing the output with respect to the introducer elements 8,12. In other words, the first and second split drive rollers 40,44 are the first rollers that intercept the N1, N2 slivers in output from the respective introducer elements 8,12.

Preferably, the slivers N1, N2 are fed according to a longitudinal feed direction L, the introducer elements 8,12 are juxtaposed along a transverse direction Z, perpendicular to said longitudinal feed direction L.

It is to be noted that the longitudinal direction L is typically inclined with respect to a vertical direction Y, perpendicular to a horizontal direction X, parallel to a support plane of the spinning apparatus 4.

The first and second split drive rollers 40,44 are aligned parallel to said transverse direction Z and rotate around the transverse rotation axes parallel to the transverse direction Z.

The number of pairs of drawing rollers 28 may be varied according to the total drawing ratio to be obtained and is not binding for the purposes of the present invention.

For example, the use of two or more slivers in the feed and the resulting increase in the size of the incoming sliver may require the insertion also of a fifth pair of drawing rollers to ensure the correct distribution of the drawing along its path (where usually 4 pairs of drawing rollers are used). The drawing ratio is given by the ratio between the incoming yarn count and the outgoing yarn count.

In general, the addition of a fifth pair of drawing rollers allows the main drawing ratio to be kept constant and does not require the other ratios to be significantly increased, which in itself is much less efficient than the main drawing carried out with a belt 48.

Preferably, said main drawing is between 20 and 50; each pair of drawing rollers or cylinders 28 carries out a drawing between 1 and 4 times. Altogether, the total drawing should be less than 350. It should be noted that the values provided above are indicative and not exclusive: for these reasons, such values may be modified without thereby departing from the scope of protection of the present invention.

The operation and therefore the drawing method for spinning machines according to the present invention will now be described.

In particular, the drawing method for multiple-feed air spinning machines with the present invention comprises the steps of:

preparing at least two slivers N1, N2 of textile fibers to be fed by means of a respective first introducer element 8 and a second introducer element 12, upstream of an air spinning device 16, drawing said slivers N1, N2, separated from each other, with a plurality of pairs of drawing rollers 28, comprising at least one drive roller 32 per pair 28, said drawing rollers 28 being suitable to carry out a progressive drawing of each sliver N1, N2 simultaneously intercepted by them, feeding said drawn and separated slivers N1, N2 into a spinning chamber 20 of the air spinning device 16 so as to blend them within said spinning chamber 20 and to obtain in output a desired blended yarn F.

Said two slivers N1, N2 of textile fibers may either be the same as each other or different in quality, yarn count, color and/or material.

Regardless of whether the individual slivers N1, N2 are the same or different from each other, even only partially, a single blended yarn F will be obtained in output from the spinning chamber 20: in other words, the concept of blended yarn is to be understood as yarn consisting of at least two starting slivers, suitably drawn, regardless of whether the slivers are the same or different from each other. Some examples of commonly used blended yarns may be a yarn of a certain count with 50% cotton and 50% polyester or mélange yarns with 60% white and 40% black.

These examples are purely indicative and do not limit the possible applications of the present invention.

According to a possible embodiment, the method comprises the step of modifying the degree of drawing of the two slivers N1, N2 at the passage of the slivers of equal yarn count through said pairs of drawing rollers 28 so as to feed into the spinning chamber 20 slivers that are separate from each other and drawn with different degrees of drawing, i.e., in a particular ratio, for example 60% cotton and 40% polyester.

It is also possible to provide for the step of drawing the two slivers N1,N2 with the same drawing.

According to a possible embodiment, the method comprises the steps of:

mechanically splitting at least one drive roller 32 of a pair of said drawing rollers 28, mutually facing each other, so as to have a first split drive roller 40, which intercepts a first sliver N1, and a second split drive roller 44, which intercepts the second sliver N2, operating in rotation, at different speeds of rotation, the first and the second split drive rollers 40, 44 so as to obtain different degrees of drawing between the two slivers N1, N2 intercepted by them, wherein said first drive roller 40 is associated with a first idle roller 52 and said second drive roller 44 is associated with a second idle roller 56, said idle rollers 52,56 being mechanically separate from each other, the method comprising the step of feeding said slivers (N1, N2) drawn and separate from each other into a spinning chamber 20 of the air spinning device 4 to obtain a desired blended warn F.

Preferably, the drawing method comprises the steps of:

associating with said first idle roller 52 a first thrust means 60 that elastically biases it in contact with the first drive roller 40, and associating with said second idle roller 56 a second thrust means 64 that elastically biases it in contact with the second drive roller 44, adjusting separately the elastic load of each of said thrust means 60,64 according to the yarn F to be obtained.

Figure 6:
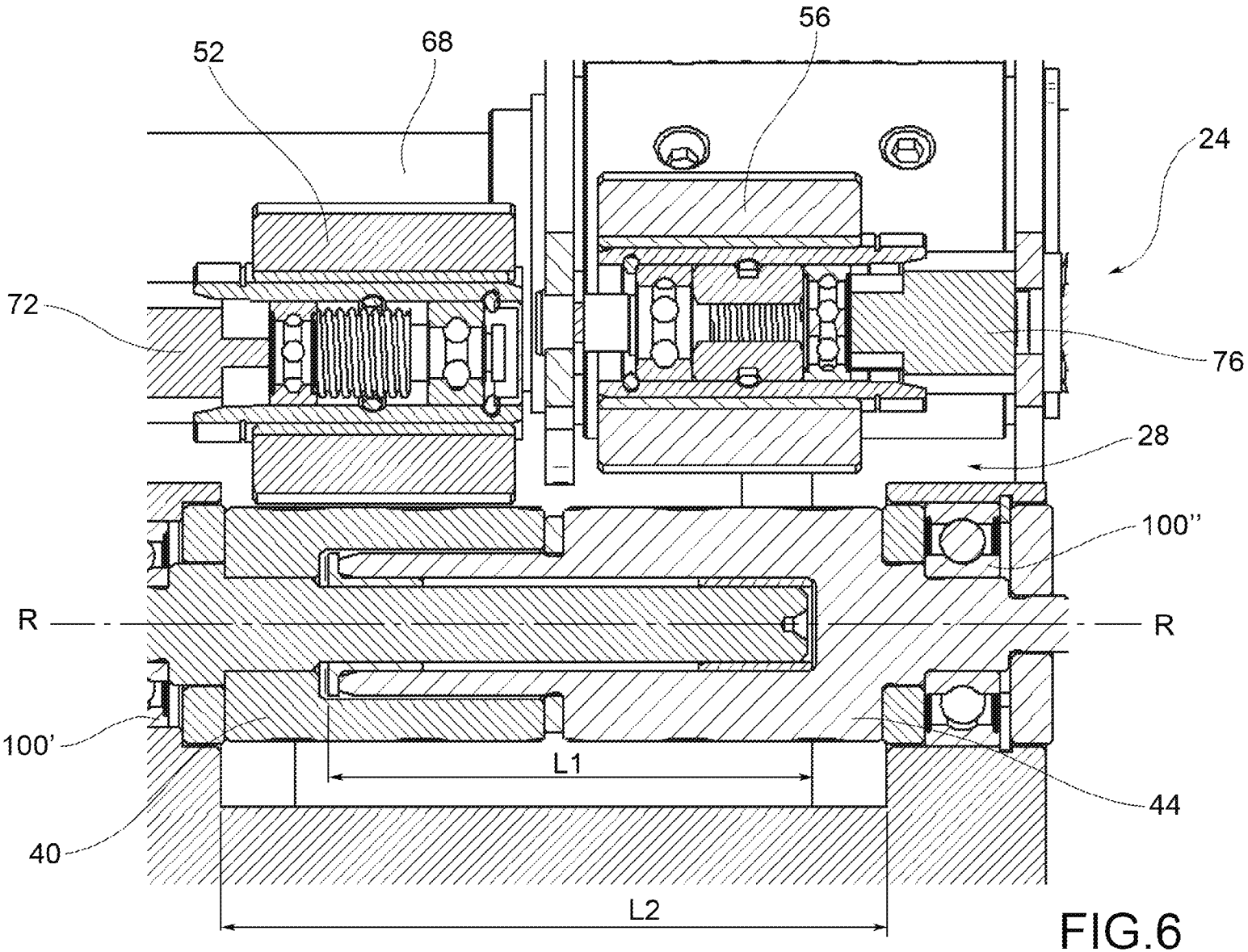
Figure 7:
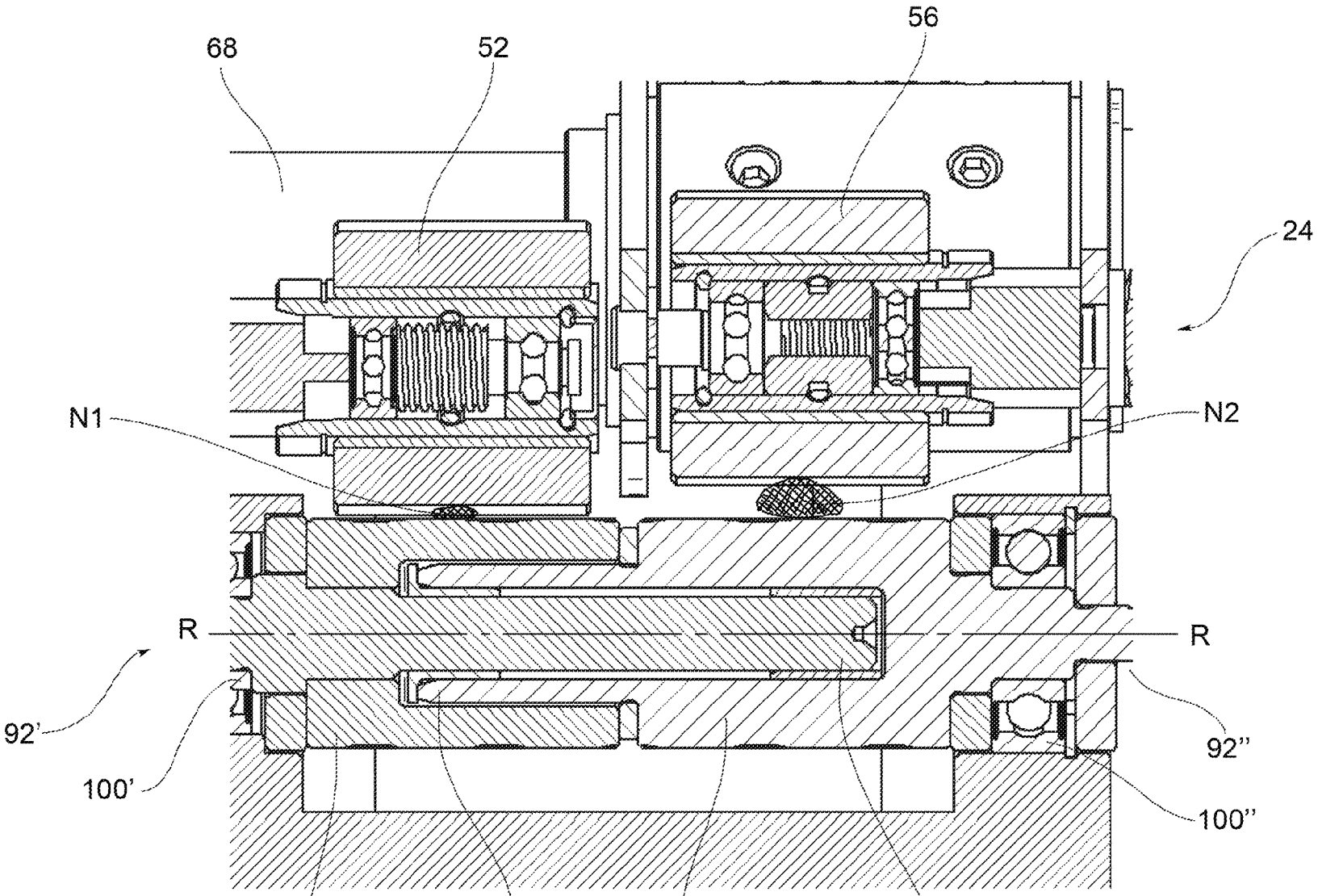

It should be noted that the thrust means 60, 64 are independent from each other in order to guarantee the same mechanical drawing performance on the individual slivers F1, F2, even if they require different working pressures, a condition that may be obtained if the slivers have different friction and/or if the yarn counts are substantially different and require different geometric configurations (FIGS. 6-7).

According to a further embodiment, the drawing method comprises the step of at least partially interpenetrating inner ends 90',90", opposite each other, of said first and second drive rollers 40,44, so as to ensure that said drive rollers 40,44 are coaxial regardless of the different loads exerted by the thrust means 60,64.

Preferably, it also comprises the step of providing for interposing at least one bearing or bushing 96 between said inner ends 90',90" partially interpenetrating each other.

According to a possible embodiment, the method comprises the steps of:

mechanically splitting at least two drive rollers 28 of two separate pairs of drawing rollers respectively into a first, a second, a third and a fourth split drive roller, in order to operate at different speeds of rotation said split drive rollers 28 to obtain different degrees of drawing between the two slivers N1, N2 intercepted by them.

Preferably, the slivers N1, N2 are fed in a longitudinal feed direction L, the introducer elements 8,12 are juxtaposed in a transverse direction Z, perpendicular to said longitudinal feed direction L, the split drive rollers 40, 44 are aligned with each other parallel to said transverse direction Z and rotate around transverse rotation axes, parallel to the transverse direction Z.

According to a possible embodiment, the method comprises the steps of:

establishing the final yarn count of the blended yarn F and any desired percentage of blend ratio to be obtained after spinning, starting from at least two separate slivers N1, N2, fixing a starting yarn count of the slivers N1, N2, separate from each other, said starting yarn count being the same for both slivers N1, N2, differentiating from each other the degree of drawing of the two slivers N1, N2, acting on a differentiated speed regulation of the drawing rollers 28 acting independently on the separate slivers N1, N2 to obtain, following blending of the slivers in the spinning chamber 20, a final blended yarn F having the final predefined yarn count and any blend percentage ratio desired.

It should be noted that the use of base slivers N1, N2 having the same yarn count is not mandatory, even if represents an advantage with respect to the known solutions, as better described hereinafter. It is, however, possible to use base slivers having any starting yarn count and to modify the degree of drawing according to the yarn count of the final yarn F to be obtained.

As seen, the spinning method comprises the step of directing air jets on the slivers, inside the spinning chamber 20, in a direction substantially tangential to the same slivers, so as to interweave said slivers N1, N2 together and obtain a single yarn F in output from the air spinning chamber 20.

As may be appreciated from the foregoing, the air-jet type spinning device and method according to the invention allow the drawbacks presented in the prior art to be overcome.

In particular, the present invention allows blended yarns to be obtained by maintaining single slivers and merging them only in feeding to the air spinning device, which will blend them in the chamber and thus obtain the same result as traditional methods while skipping all the additional operations (which increase the production times and costs).

The use of separately motorized drawing axes and the use of independent loads on the idle rollers truly allows the different degrees of drawing on the single slivers to be optimized. In other words, due to the independent variation of the rotation speed of the drawing rollers and due to the also independent variation of the loads acting on the idle rollers, it is possible to make the apparatus extremely sensitive to the imposed variations, and therefore it is possible to obtain extremely precise variations of the degrees of drawing on the single slivers.

Moreover, always with a view to a correct setting of the drawing parameters, it is important to maintain the coaxiality between the rotation axes of the drive rollers, even if they work under different loads, by the action of the different loads imposed by the idle rollers. For this object, the present invention allows the perfect coaxiality between the rotation axes to be always guaranteed, due to the particular support structure of the drive rollers. In this way, the precision of the settings of the loads imposed by the idle rollers is guaranteed, and thus the effectiveness of the variations applied to the different rollers to have separate degrees of drawing.

Thus the complete separation of the degrees of drawing and the loads on the rollers allows for an extremely precise and reliable adjustment of the different drawing degrees imposed on the slivers until they enter the spinning chamber. The special support structure of the rollers makes it possible to guarantee the coaxiality between the rollers and thus the exact degree of drawing imposed by the rollers, i.e., the precision of said adjustments.

Furthermore, it is possible to use combed cotton slivers in appropriate blends with carded cotton slivers, allowing the cotton to be spun with materials that cannot be processed with traditional air spinning systems.

This method also allows the use of two equal slivers, for example having a single drawing passage instead of the three currently used in traditional air spinning machines as the defects of the individual slivers are statistically reduced in their coupling and subsequent blending.

In the production of blended yarns, the desired percentage of individual materials in the final yarn is obtained by working on the yarn counts of the individual incoming slivers. For example, to obtain a yarn with 60% cotton and 40% polyester, it would be sufficient to feed the machine two slivers having yarn counts of Ne 0.18 and Ne 0.27 respectively.

The present invention allows the use of slivers having all the same yarn count and to vary the degree of drawing thereof directly on the spinning machine, obtaining a final yarn having the final predefined yarn count and any desired blend percentage. For example, to obtain a blended 60% cotton 40% polyester yarn, one could use two slivers of the same yarn count, for example Ne 0.18, and then draw them 100 and 150 times (or at a ratio of 1.5:1), respectively.

This methodology represents a remarkable simplification with respect to the known solutions for the production of blended yarns as it allows the degree of drawing to be varied without increasing the preparation work, since it is possible to use basic slivers having all the same yarn count and to change the degree of drawing directly on the spinning machine according to the final yarn count one desires to obtain and the blend percentage. The different degree of drawing will be calculated automatically by the processing and control unit of the spinning apparatus after entering the initial yarn count values and the final yarn count value desired.

A particularly advantageous application of the present invention is spinning with slivers of different quality. It is possible, for example, to insert a carded cotton sliver, typical of the open end systems, and a combed cotton sliver (with 1, 2 or 3 drawing frame passages) typical of air spinning and more "highly valued", in variable percentages (from 70%–30% to 90%–10% depending on the quality of the two slivers), managing to work with the air system equipment typical of the open end system, obtaining good yarn features, better than those of the open end systems but with almost double speeds and lower processing costs. Currently, however, air spinning machines provide for feeding with combed cotton slivers with 3 drawing passages to obtain an extremely homogeneous fiber with the longest length possible. Clearly, this has, as a drawback, a high cost because it discards much valuable material and increases the overall duration of the processing cycle.

Moreover, the present invention finds an advantageous application also for mono-material yarns (i.e. non-blended), because it provides the possibility of using the feed with a single drawing passage rather than the 3 highly recommended by the machines present in the current market, with the same final quality in the yarn. In effect, from a statistical point of view, the defects of the individual slivers are added algebraically, giving a resulting sliver that allows spinning with improved features (especially spinnability).

A person skilled in the art, to satisfy contingent and specific requirements, may make numerous modifications and variations to the air-jet type spinning devices and methods for blended yarns described above, all of which are within the scope of the invention as defined by the following claims.

The invention claimed is:

1. Drawing apparatus (4) for air spinning machines with multiple feeds, comprising:

at least a first and a second introducer element (8,12), independent of each other, so as to be able to feed simultaneously at least two separate slivers (N1, N2) of textile fiber, an air spinning device (16) suitable to spin said slivers (N1, N2) of textile fiber, a drawing device (24) placed between the introducer elements (8, 12) and the air spinning device (16), comprising a plurality of pairs of drawing rollers (28), comprising one drive roller (32) and one idle roller (36) per pair, said drawing rollers (28) being suitable to perform a progressive drawing of each sliver simultaneously intercepted by them, characterized in that at least one drive roller (32) of a pair of said drawing rollers (28) is mechanically split into a first drive roller (40) which intercepts a first sliver (Ni) and a second drive roller (44) which intercepts the second sliver (N2), said first and second drive rollers (40,44) being operatively connected to separate drive means so that they may be operated at different speeds of rotation, to perform different degrees of drawing of the at least two slivers (N1, N2) intercepted by said first and second drive roller (40,44), wherein said first drive roller (40) is associated with a first idle roller (52) and said second drive roller (44) is associated with a second idle roller (56), said idle rollers (52,56) being mechanically separate from each other, and wherein said first idle roller (52) is associated with a first thrust means (60) that elastically biases it in contact with the first drive roller (40) and said second idle roller (56) is associated with a second thrust means (64) that elastically biases it in contact with the second drive roller (44).

2. Drawing apparatus (4) for air spinning machines with multiple feeds according to claim 1, wherein said first and second thrust means (60,64) are entirely independent of each other.

3. Drawing apparatus (4) for air spinning machines with multiple feeds according to claim 1, wherein said first and second thrust means (60,64) comprise coil springs and/or leaf springs.

4. Drawing apparatus (4) for air spinning machines with multiple feeds according to claim 1, wherein said first and second idle rollers (52,56) are cantilevered relative to a frame (68) of the drawing device (24), on support shafts (72,76) mechanically separate from each other.

5. Drawing apparatus (4) for air spinning machines with multiple feeds according to claim 1, wherein said first and second thrust means (60,64) comprise springs that can be adjusted separately from each other.

6. Drawing apparatus (4) for air spinning machines with multiple feeds according to claim 1, wherein said first and second drive rollers (40,44) are coaxial with each other.

7. Drawing apparatus (4) for air spinning machines with multiple feeds according to claim 1, wherein said first and second drive rollers (40,44) are supported by drive shafts (84,88) coaxial with each other and fixed in position with respect to a frame (68) of the drawing device (24).

8. Drawing apparatus (4) for air spinning machines with multiple feeds according to claim 1, wherein said first and second drive rollers (40,44) are axially opposed with respect to a common rotation axis (R-R), by the inner ends (90',90"), facing each other, and are rotatably supported by the outer ends (92' ,92"), opposite said inner ends (90',90").

9. Drawing apparatus (4) for air spinning machines with multiple feeds according to claim 8, wherein said inner ends (90',90") are at least partially coaxially interpenetrated with each other so as to rotate one inside the other through the interposition of at least one bearing or bushing (96).

10. Drawing apparatus (4) for air spinning machines with multiple feeds according to claim 9, wherein said inner ends (90',90") interpenetrate each other for a length of interpenetration (L1) equal to at least 50% of a total cantilevered length (L2) between said outer ends (92' ,92").

11. Drawing apparatus (4) for air spinning machines with multiple feeds according to claim 1 , wherein said first and second split drive rollers (40,44) are arranged facing the output with respect to the introducer elements (8, 12).

12. Drawing apparatus (4) for air spinning machines with multiple feeds according to claim 1, wherein the slivers (N1, N2) are fed in a longitudinal feed direction (L), the introducer elements (8,12) are juxtaposed in a transverse direction (Z), perpendicular to said longitudinal feed direction (L), the split drive rollers (32) are aligned with each other parallel to said transverse direction (Z) and revolve around transverse rotation axes, parallel to the transverse direction (Z).

13. Drawing apparatus (4) for air spinning machines for blended yarns according to claim 1 further comprising a spinning chamber (20), wherein said spinning chamber (20) comprises a plurality of air jets oriented in a direction substantially tangential to said slivers entering the spinning chamber room (20), so as to interweave said slivers (N1, N2) and obtain a single yarn (F) in output from the air spinning chamber (20).

14. Drawing method for air spinning machines with multiple feeds, comprising the steps of:

preparing at least two slivers of textile fibers (N1, N2), to be fed by at least a respective first introducer element (8) and a second introducer element (12), upstream of an air spinning device (16), drawing said slivers (N1, N2), separate from each other, with a plurality of pairs of drawing rollers (28), comprising one drive roller (32) and one idle roller (36) per pair, said drawing rollers (28) being suitable to perform a progressive drawing of each sliver (N1, N2) simultaneously intercepted by them, wherein at least one drive roller (32) of a pair of said drawing rollers (28), is mechanically split into a first drive roller (40), which intercepts a first sliver (N1) and a second drive roller (44), which intercepts the second sliver (N2), said first and second drive rollers (40,44) being operatively connected to separate drive means so that they may be operated at different speeds of rotation, to perform different degrees of drawing of the at least two slivers (N1, N2) intercepted by said first and second drive roller (40,44), wherein said first drive roller (40) is associated with a first idle roller (52) and said second drive roller (44) is associated with a second idle roller (56), said idle rollers (52,56) being mechanically separate from each other, the method comprising the step of feeding said slivers (N1, N2) drawn and separate from each other into a spinning chamber (20) of the air spinning device (4) to obtain a desired blended yarn.

15. Drawing method for air spinning machines with multiple feeds according to claim 14, comprising the steps of:

associating with said first idle roller (52) a first thrust means (60) that elastically biases it in contact with the first drive roller (40) and associating with said second idle roller (56), a second thrust means (64) that elastically biases it in contact with the second drive roller (44), adjusting separately the elastic load of each of said thrust means (60,64) according to the yarn (F) to be obtained.

16. Drawing method for air spinning machines with multiple feeds according to claim 15, comprising the step of at least partially interpenetrating inner ends (90',90"), opposite each other, of said first and second drive rollers (40,44), so as to ensure that said drive rollers (40,44) are coaxial regardless of the different loads exerted by the thrust means (60,64).

17. Drawing method for air spinning machines with multiple feeds according to claim 16, comprising the step of providing for the interposition of at least one bearing or bushing (96) between said inner ends (90',90") partially interpenetrated with each other.

18. Drawing method for air spinning machines with multiple feeds according to claim 14, wherein said at least two slivers (N1, N2) of textile fibers are the same as each other.

19. Drawing method for air spinning machines with multiple feeds according to claim 14 , wherein said at least two slivers (N1, N2) of textile fibers are different from each other in terms of quality, color, yarn count and/or material.

20. Drawing method for air spinning machines with multiple feeds according to claim 14, comprising the step of:

modifying the degree of drawing of the at least two slivers (N1, N2), upon transit through said pairs of drawing rollers (28), so as to feed to the spinning chamber (20) slivers that are separate from each other and with different degrees of drawing.

21. Drawing method for air spinning machines with multiple feeds according to claim 14, comprising the steps of:

establishing the final yarn count and any desired percentage blend ratio to be obtained after spinning, starting from at least two separate slivers (N1, N2), establishing a starting yarn count of the separate slivers, said starting yarn count being the same for both slivers (N1, N2), differentiating between them the degree of drawing of the at least two slivers (N1, N2), acting on a differentiated speed adjustment of the drawing rollers (28) acting independently on the separate slivers (N1, N2) to obtain, following blending of the slivers (N1, N2) in the spinning chamber (20), a yarn (F) having the final predefined yarn count and any desired blend percentage ratio.

* * * * *